US005996856A

United States Patent [19]

Duncan

[11] Patent Number: 5,996,856

[45] Date of Patent: Dec. 7, 1999

[54] MORTARING MADE EASIER

[76] Inventor: Joseph C. Duncan, 28 Creek Meadow La., Rochester, N.Y. 14626

[21] Appl. No.: 08/876,328

[22] Filed: Jun. 16, 1997

[51] Int. Cl.[6] ..... E04G 21/22

[52] U.S. Cl. ..... 222/413; 52/749.14

[58] Field of Search ..... 222/413; 52/749.14

[56] References Cited

U.S. PATENT DOCUMENTS

| | | | |
|---|---|---|---|
| 1,716,317 | 6/1929 | Lowy | 222/413 X |
| 4,629,094 | 12/1986 | Vogel et al. | 222/413 X |
| 4,829,737 | 5/1989 | Anliker | 52/749.14 |
| 4,953,752 | 9/1990 | Tousignant et al. | 222/413 X |
| 5,265,773 | 11/1993 | Harada | 222/413 X |
| 5,284,000 | 2/1994 | Milne et al. | 52/749 |
| 5,655,692 | 8/1997 | Navin et al. | 222/413 |

*Primary Examiner*—Janice L. Krizek

[57] ABSTRACT

The entire second apparatus containing components bolted together is designed to hold motors that are made to run simultaneously or independently, and has a hydraulic system to lay a bed of mortar on a wall to be built and also has the means to keep from clogging the hose, container and cover by installing throw-away plastic liners. The apparatus has the ability to travel on the existing rail system, and for a mortar tray to be raised to a desired height that a mason is comfortable with. It also has special frames when installed for a low scaffold is in place on an existing scaffold it will obtain the desire height and eliminate much of the outriggers that are now installed. Also a low dolly for placement on a rail system can dispense material where needed, also the apparatus has the ability to place bricks or blocks on a bedded wall, thus eliminating many back strains. This additional method too, is mortaring made easier.

1 Claim, 3 Drawing Sheets

MORTARING MADE EASIER

CROSS-REFERENCE TO RELATED APPLICATIONS

Not Applicable

BACKGROUND OF THE INVENTION

1. Field of the Invention

This invention relates to a masonry procedure to dispense mortar on a wall being built, also to further my U.S. Pat. No. 5,527,145.

2. Description of Related Art

This relates to U.S. Pat. No. 5,284,000, Inventors: W. Warren Mine, Jacek A. Wiercienski, Pawel Kuzan.

BRIEF SUMMARY OF THE INVENTION

The method for decades has been the same. Since the invention of the trowel, mortar has been picked up one trowel scoop at a time and hand-carried for placement on a wall as it is built, making for tedious work. Several automated brick machines have been patented, most of which have several shortcomings. The proposed machinery to dispense mortar under pressure is not reliable in an automated process since mortar has the tendency to clog pumps and conduits. Also, the machinery requires excessive handling. Also, the cost of laying one brick at a time. This invention relates to a masonry procedure specifically to further my invention disclosed in Pat. No. 5,527,145. The method is to have an apparatus lay a bed of mortar where needed.

DETAILED DESCRIPTION OF THE INTENTION

Figure 1:
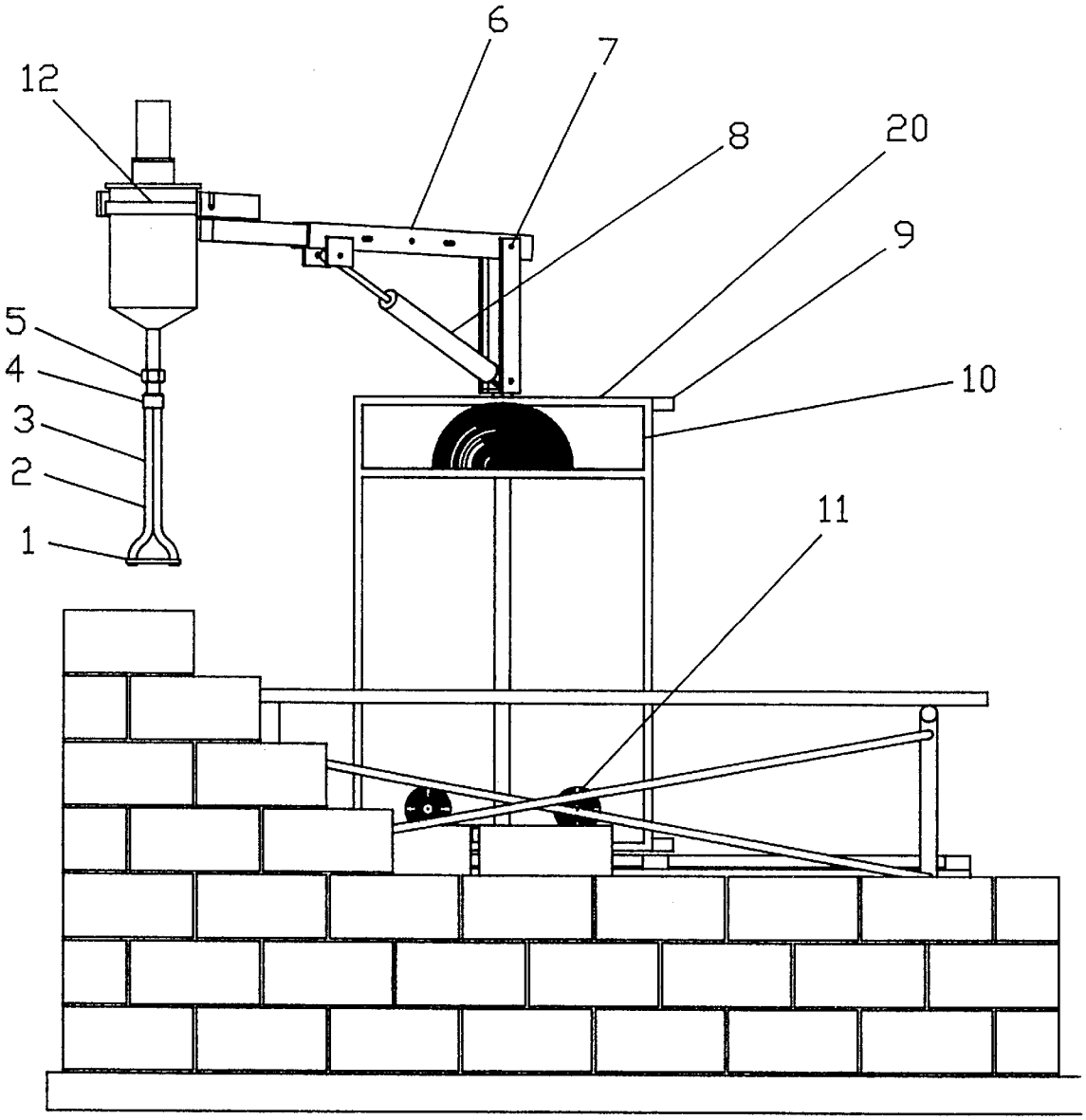
FIG. 1 is a perspective view of member 12.
Figure 2:
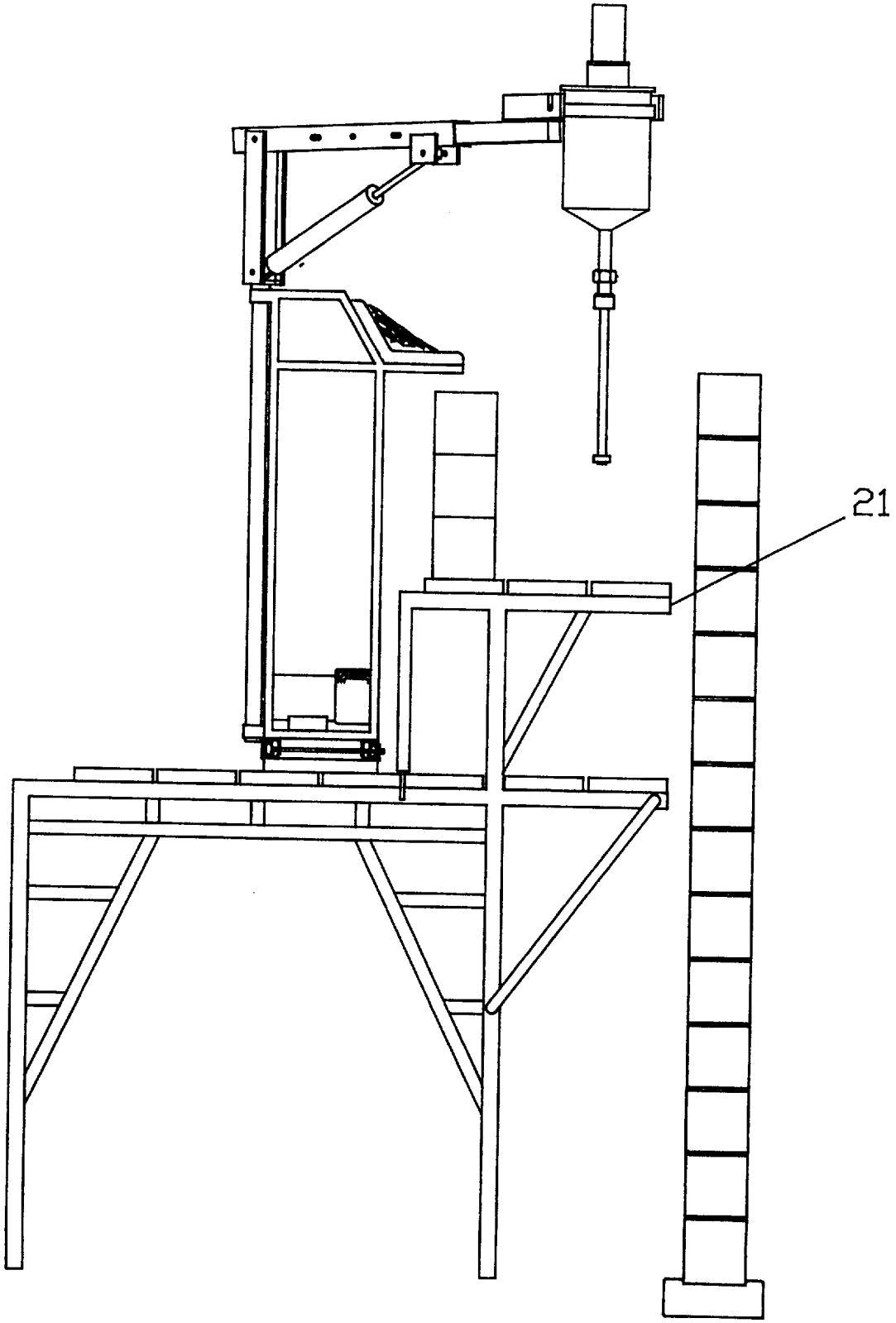
FIG. 2 shows the low scaffold assembly 21 and the elevatable mortar tray 10.
Figure 4:
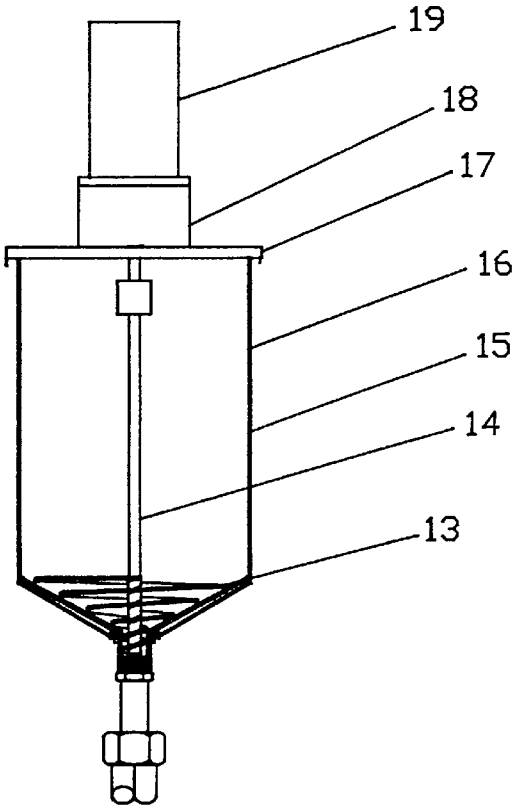
FIG. 4 shows a worm gear 13, extension shaft 14, container 15, plastic liner 16, cover 17, a motor plate assembly 18 and a motor 19.
Figure 3:
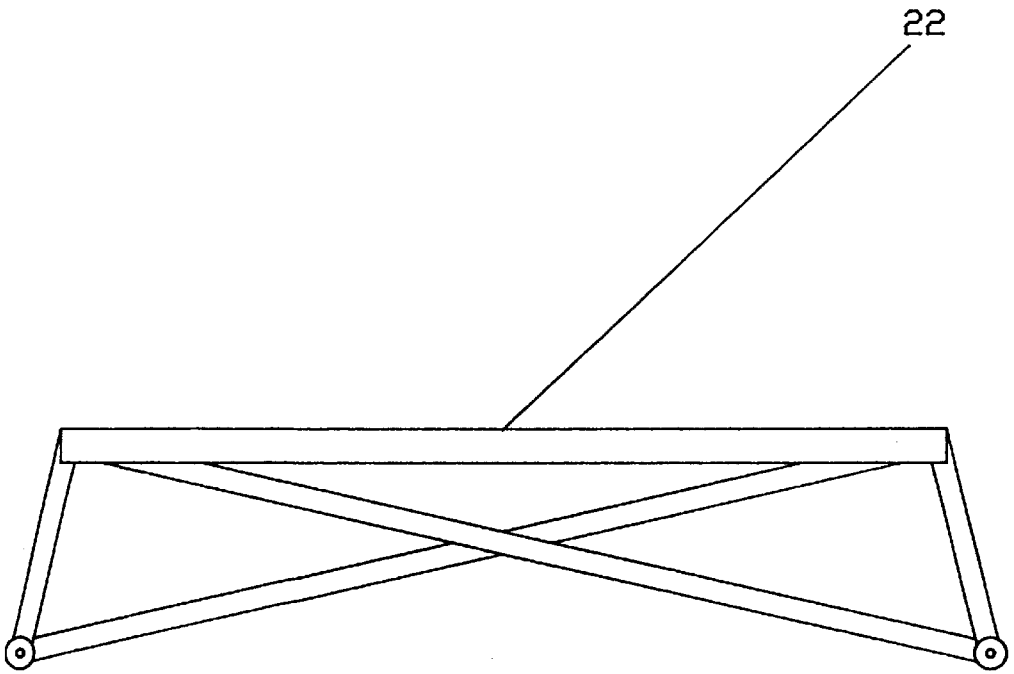
FIG. 3 shows the low dolly member 22.

The apparatus has a container 15 placed in a cradle assembly 12. The container 15 will remain clean since a plastic liner 16 is installed and can easily be removed. The plastic liner is also installed in cover 17. Cradle assembly 12 is bolted to an upper arm assembly 6. FIG. 1 shows a spreader holder assembly 1 installed at the base of a tube 3 dispenses mortar to the correct width when laying a bed of mortar on a wall. Spreader holder assembly 1 has means to spread apart the tube 3 to the correct width. A throw-away plastic liner 2 is inserted in the tube 3, which can be easily discarded, thus keeping the tube from clogging, and a clamp 4 squeezes the tube. A threaded nut 5 is also connected to the tube and the funnel of container 15. An upper arm assembly 6, a bolt 7, a hydraulic cylinder 8, a holder 9 having means to lock the upper arm 6 and a frame assembly 20 are part of the apparatus. FIG. 2 shows a low scaffold frame assembly 21 that will enable a higher placing of blocks. The low scaffold frame assembly 21 enables a mason to mortar a wall high enough to elevate to the next normal scaffold height, thus eliminating an operation of installing outriggers with planks that are placed on them that are located half-way on a scaffold next to a wall. The mortar tray 10 can be elevated to a height a mason can be comfortable with when having to stand on the low scaffold frame assembly 21. FIG. 3 shows a low dolly 22, which when inserted in the track system, can place material where needed. FIG. 4 shows a cover 17 on container 15. A motor shaft extending through the cover is connected to extension shaft 14. The extension shaft 14 is connected also to a worm gear 13 that can put pressure downward on mortar when in the tube 3. The cover 17 is bolted to a motor plate assembly 18. A motor 19 is also bolted to the plate assembly 18. Motors 11 and 19 can be synchronized or run independently to place mortar on a wall.

Accordingly, the reader will see that this invention can be beneficial to everyone involved in this endeavor using a second apparatus to lay a bed of mortar to a specific width and length. The apparatus can travel. Also, the track system will enable laying a bed of mortar in a straight line. Also having special frames to build a low scaffold with three planks shown in FIG. 2 for a mason to stand on, and raising the mortar tray to a desired height, will enable a wall to be built to the next scaffold height. A low dolly inserted in the rails will also give the apparatus the means to pick block or bricks off the dolly and place them directly on a bedded wall, thereby eliminating carrying and lifting of brick, or blocks. Also, installation of throw-away liners will maintain the container, the cover and the tube with a minimum amount of cleaning.

I claim:

1. An apparatus for dispensing mortar comprising:

a frame assembly movable along rails, said frame assembly having a vertically movable mortar tray for holding mortar;

a support member mounted on said frame assembly;

an upper arm member pivotally connected at a proximal end thereof to said support member;

a fluid cylinder connected to said support member and to said upper arm member for selectively pivoting said upper arm member relative to said support member;

a cradle mounted on a distal end of said upper arm member;

a container supported by said cradle, said container having an open top and a bottom;

a cover having a top side, said cover enclosing the open top of said container, said cover having a container liner attached thereto which extends into said container, a motor mounted on the top side of said cover having a motor shaft extending through said cover, said motor shaft having an extension shaft connected thereto, said extension shaft having a worm gear connected thereto, said motor rotating said motor shaft, said extension shaft and said worm gear to force a quantity of mortar contained in said container liner from the bottom of said container;

a tube depending from the bottom of said container, said tube having a tube liner;

a clamp mounted on said tube for squeezing said tube; and a spreader assembly mounted to a distal end of said tube for dispensing mortar flowing through said tube.

* * * * *